US006559839B1

(12) United States Patent
Ueno et al.

(10) Patent No.: US 6,559,839 B1
(45) Date of Patent: May 6, 2003

(54) IMAGE DISPLAY APPARATUS AND METHOD USING OUTPUT ENABLE SIGNALS TO DISPLAY INTERLACED IMAGES

(75) Inventors: Hiroshi Ueno, Tokyo (JP); Jun Someya, Tokyo (JP); Masaru Nishimura, Kumamoto (JP)

(73) Assignees: Mitsubishi Denki Kabushiki Kaisha, Tokyo (JP); Advanced Display Inc., Kumamoto (JP)

( * ) Notice: Subject to any disclaimer, the term of this patent is extended or adjusted under 35 U.S.C. 154(b) by 0 days.

(21) Appl. No.: 09/532,953

(22) Filed: Mar. 22, 2000

(30) Foreign Application Priority Data

Sep. 28, 1999 (JP) ..... 11-273920

(51) Int. Cl.[7] ..... G09G 5/00

(52) U.S. Cl. ..... 345/213; 345/3.1; 345/3.2; 348/446; 348/448

(58) Field of Search ..... 345/213, 3.1, 3.2, 345/3.3, 3.4, 98, 99; 348/446, 448, 459

(56) References Cited

U.S. PATENT DOCUMENTS 4,908,710 A * 3/1990 Wakai et al. ..... 345/103
5,091,784 A * 2/1992 Someya et al. ..... 345/634
5,933,196 A * 8/1999 Hatano et al. ..... 348/441
6,239,779 B1 * 5/2001 Furuya et al. ..... 345/87
6,429,836 B1 * 8/2002 Hansen ..... 345/74.1

FOREIGN PATENT DOCUMENTS

JP 11-164231 6/1999 ..... G09G/3/36

* cited by examiner

*Primary Examiner*—Amare Mengistu
*Assistant Examiner*—Jimmy H. Nguyen
(74) *Attorney, Agent, or Firm*—Birch, Stewart, Kolasch & Birch

(57) ABSTRACT

A matrix display panel has scan lines that are selected in consecutive order. An interlaced image signal is displayed by the use of one or more output enable signals that enable only every second selected scan line to be driven. A progressively scanned image signal having a frame rate too high to be handled by the matrix display panel is displayed as an interlaced image, by use of the same output enable signals. Consequently, no frame memory is needed for scanning conversion or frame-rate conversion.

17 Claims, 7 Drawing Sheets

IMAGE DISPLAY APPARATUS AND METHOD USING OUTPUT ENABLE SIGNALS TO DISPLAY INTERLACED IMAGES

BACKGROUND OF THE INVENTION

The present invention relates to an apparatus and method for displaying images on a matrix display panel such as a liquid crystal display panel.

Liquid crystal display panels are widely used as monitor displays for personal computers and workstations. These monitor display panels are conventionally designed for progressive scanning. Horizontal rows of picture elements or pixels are driven one at a time, in sequence from the top of the display to the bottom. These horizontal rows are referred to below as scan lines. All of the pixels in each scan line are driven simultaneously.

With the advent of multimedia, these computer monitors are being required to display video image signals employing interlaced scanning, in which even fields, comprising only even-numbered scan lines, alternate with odd fields, comprising only odd-numbered scan lines. To enable a progressively scanned monitor panel to display an interlaced image signal, the image signal is conventionally converted from interlaced to progressive scanning by use of a frame memory, or a pair of frame memories, in which the image signal is stored before being displayed. Typically, even fields are stored in one memory area and odd fields in another memory area, and scan lines are read from the two memory areas alternately. The frame memory can also act as a buffer for converting between the scanning rate or frame rate of the received image signal and the possibly different frame rate of the display panel.

A disadvantage of this conventional method is that a frame memory is expensive and takes up space. Moreover, as the resolution of the image signal increases, which is the current trend, the capacity of the frame memory must be increased, making the frame memory even more costly and space-consuming. Use of a frame memory as a buffer for frame-rate conversion is also not entirely satisfactory, as this practice can lead to image defects.

SUMMARY OF THE INVENTION

An object of the present invention is to enable images employing both progressive and interlaced scanning to be displayed on a matrix display panel, without the use of a frame memory.

Another object of the invention is to enable images having a high frame rate to be displayed at a lower frame rate while maintaining high image quality.

A further object of the invention is to reduce electromagnetic noise emissions.

The invented method of displaying an image signal on a matrix display panel comprises the steps of:

- determining whether the image signal employs interlaced scanning;
- generating a shift signal selecting the scan lines of the matrix display panel one by one in consecutive order;
- generating one or more output enable signals enabling the scan lines to be driven when selected;
- controlling the output enable signals so that every second selected scan line is driven, if the image signal employs interlaced scanning; and
- doubling the frequency of the shift signal, if the image signal employs interlaced scanning.

If the image signal employs progressive scanning, the output enable signals preferably enable every scan line to be driven, unless the frame rate of the image signal exceeds a predetermined frame rate, in which case every second scan line is driven and the scanning system is converted from progressive to interlaced.

The invented image display apparatus has a driver timing generator that generates the shift signal and output enable signals described above. The driver timing generator comprises, for example, a pair of counters and a pair of decoders. The apparatus may also comprise a panel timing generator generating a dot clock signal, and a line memory storing the image data for one scan line at a time. The panel timing generator reads the image data from the line memory in synchronization with the dot clock signal. If the image signal employs progressive scanning and has a frame rate exceeding the predetermined frame rate, the panel timing generator preferably reduces the dot-clock frequency.

Control of the output enable signals allows image signals employing both progressive and interlaced scanning to be displayed without the use of a frame memory.

When the frame rate of the image signal exceeds the predetermined frame rate, each frame is displayed as a field in which only every second scan line is driven. The frame rate is thereby reduced by a factor of two without significant loss of image quality, because image alignment defects do not occur and the field rate is still high enough to avoid flicker. Reducing the dot clock frequency in this case reduces electromagnetic noise.

DETAILED DESCRIPTION OF THE INVENTION

An image display apparatus embodying the invention will be described with reference to the attached drawings. The image signal will be referred to as a video signal.

Figure 1:
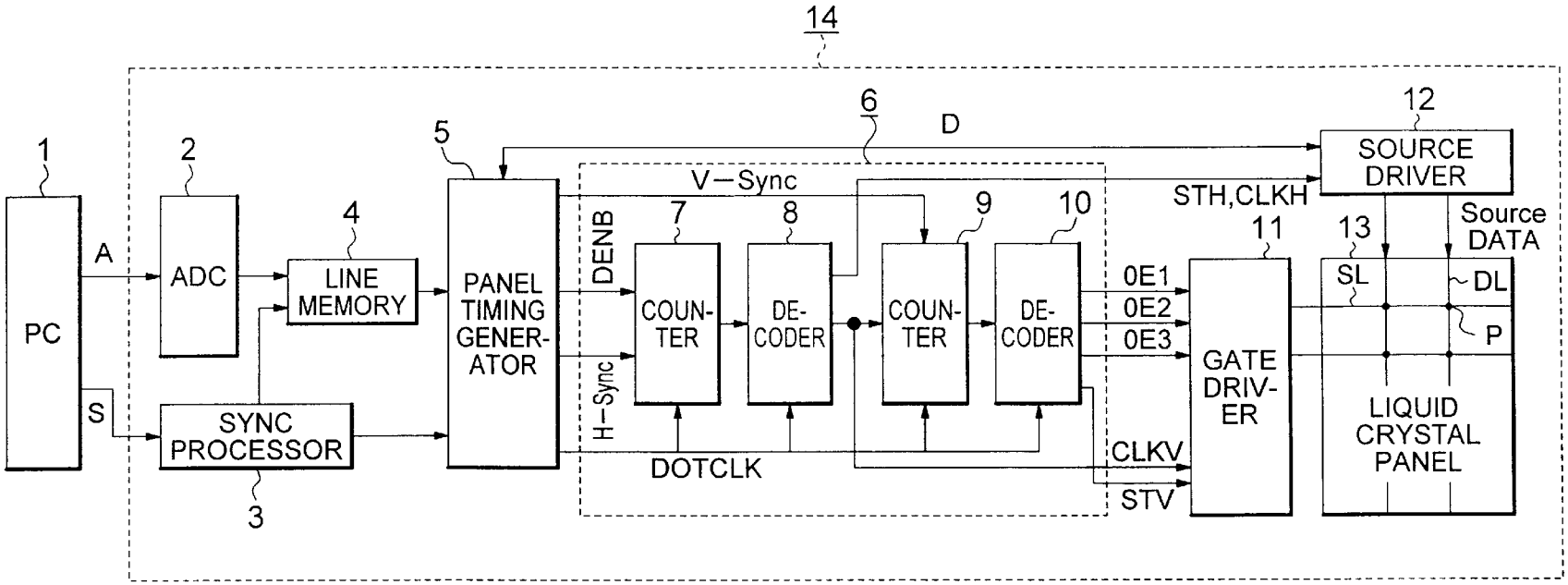
FIG. 1 is a block diagram of an image display apparatus embodying the present invention.

In FIG. 1, an analog video signal A is output from a computing device such as a workstation or personal computer (PC) 1. The computing device 1 also supplies a synchronizing signal S. The analog video signal A is received by an analog-to-digital converter (ADC) 2, which outputs a digitized video data signal. The synchronizing signal S is received by a sync processor 3 that discriminates between progressive scanning and interlaced scanning, and identifies even and odd fields in interlaced scanning. The digitized video signal output from the analog-to-digital converter 2 is stored in a line memory 4 with a capacity of data for one horizontal scan line, in synchronization with signals supplied by the sync processor 3. The digitized video signal is read from the line memory 4 by a panel timing generator 5, which operates according to signals received from the sync processor 3. From these signals, the panel timing generator 5 determines the frame rate of the video signal, and the field rate if the scanning is interlaced. The panel timing generator 5 also generates a dot clock signal (DOTCLK), a data enable signal (DENB) indicating valid intervals of the data signal read from the line memory 4, a vertical synchronizing signal (V-Sync), and a horizontal synchronizing signal (H-Sync), and supplies these signals to a driver timing generator 6.

The driver timing generator 6 comprises a first counter 7, a first decoder 8, a second counter 9, and a second decoder 10, all of which receive the dot clock. The first counter 7 also receives the data enable signal DENB and horizontal synchronizing signal H-Sync. By decoding the output of the first counter 7, the first decoder 8 generates a gate driver shift clock signal (CLKV), a source driver shift clock signal (CLKH), and a source driver start pulse signal (STH). The second counter 9 receives the vertical synchronizing signal V-Sync and gate driver shift clock CLKV. By decoding the output of the second counter 9, the second decoder 10 generates a gate driver start pulse signal (STV) and three output enable signals OE1, OE2, OE3.

The output enable signals OE1, OE2, OE3, together with the gate driver shift clock CLKV and start pulse STV, are supplied to a gate driver 11. The source driver shift clock CLKH and start pulse STH are supplied to a source driver 12. The source driver 12 also receives the data signal D read by the panel timing generator 5 from the line memory 4. The source driver 12 is coupled to a plurality of data lines DL that are coupled to the source electrodes of transistors (not visible) in a liquid crystal panel 13. The gate driver 11 is coupled to a plurality of scan lines SL that are coupled to the gate electrodes of the transistors in the liquid crystal panel 13. The data lines are oriented vertically and the scan lines horizontally, one pixel P being disposed at each intersection of the data lines and scan lines, each pixel having a separate transistor. When a scan line is driven, capacitors (not visible) in the pixels on that scan line are charged simultaneously according to the data signals (SourceDATA) output by the source driver 12.

The above elements, except for the computing device 1, constitute the image display apparatus 14.

The scan lines SL in the liquid crystal panel 13 are numbered one, two, three, . . . in order from top to bottom. The first output enable signal OE1 is supplied to circuits in the gate driver 11 that drive scan lines with numbers of the form 3n+1, where n is an arbitrary integer. The driving of these scan lines (numbered 1, 4, 7, . . . ) is enabled when OE1 is low, and disabled when OE1 is high. Similarly, the second output enable signal OE2 enables the scan lines with numbers of the form 3n+2 (2, 5, 8, . . . ) to be driven, and the third output enable signal OE3 enables scan lines with numbers of the form 3n+3 (3, 6, 9, . . . ) to be driven.

The gate driver 11 selects the individual scan lines one at a time, the selected scan line shifting downward by one line per cycle of the gate driver shift clock CLKV. When selected, a scan line is driven if the relevant output enable signal is low.

The panel timing generator 5 also supplies the driver timing generator 6 with mode signals, not indicated in the drawing, that control the operation of the decoders 8, 10 according to the scanning type (progressive or interlaced) and, in case of interlaced scanning, the field type (even or odd).

Next, the operation of the display apparatus in FIG. 1 will be described. It will be assumed that the liquid crystal panel 13 has seven hundred sixty-eight (768) horizontal scan lines.

The analog video signal A output by the computing device 1 is digitized by the analog-to-digital converter 2 and stored, line by line in the line memory 4. The digitized signal is read from the line memory 4 in synchronization with the dot clock generated by the panel timing generator 5. The dot clock frequency is optimized for the operation of the source driver 12, and need not be identical to the sampling frequency of the analog-to-digital converter 2.

The synchronizing signal S output by the computing device includes both horizontal and vertical synchronizing information. The sync processor 3 analyzes this information to determine whether the scanning system of the video signal A is progressive or interlaced.

Figure 2:
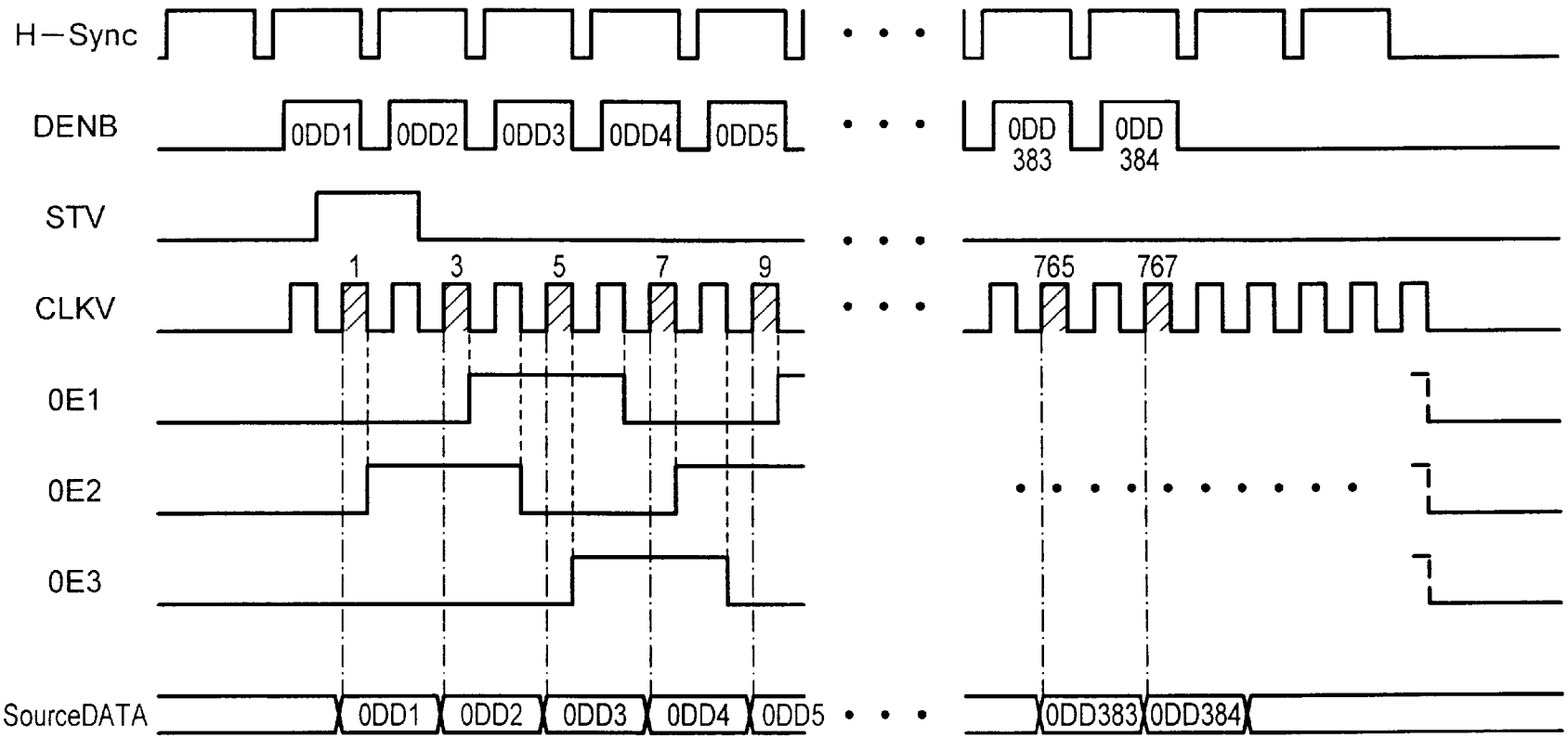
FIGS. 2 and 3 are timing diagrams illustrating the operation of the apparatus in FIG. 1 for interlaced scanning.
Figure 3:
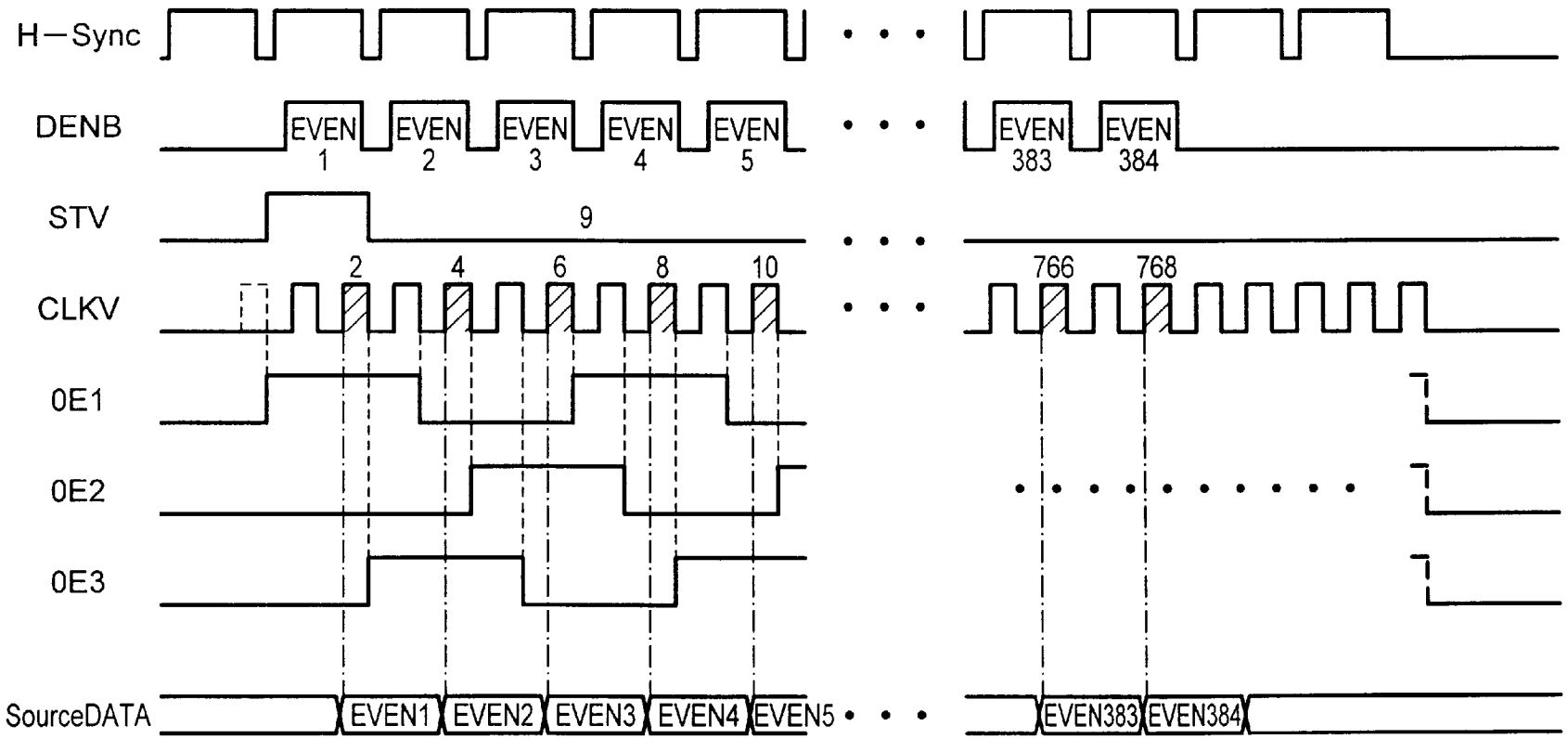

If the scanning system is interlaced, the panel timing generator 5 and driver timing generator 6 operate as illustrated in FIGS. 2 and 3. FIG. 2 shows signals generated in an odd field. FIG. 3 shows signals generated in an even field.

In both even and odd fields, by counting the dot clock, the first counter 7 and first decoder 8 determine the period of the horizontal synchronizing signal H-Sync, and set the period of the gate driver shift clock CLKV to one half of that period, so that the CLKV frequency is doubled with respect to the H-Sync frequency. The pulse width of CLKV is one-fourth the H-Sync period. CLKV is synchronized with the data enable signal DENB so that CLKV and DENB rise simultaneously.

The gate driver start pulse signal STV has a pulse width equal to the H-Sync period, thus equal to two CLKV periods. One STV pulse is generated at the beginning of each field. The next pulse of the gate driver shift clock CLKV after the rise of STV causes the gate driver 11 to select the first scan line, as indicated by the numeral one above this CLKV pulse in FIG. 2.

The second counter 9 is reset by the vertical synchronizing signal V-Sync, and counts pulses of the gate driver shift clock CLKV. The second decoder 10 generates the output enable signals according to the count output by the second counter 9, staggering these signals so that OE1 rises two CLKV periods after OE2, and OE2 rises two CLKV periods after OE3. All three output enable signals have periods equal to six CLKV periods and pulse widths equal to three CLKV periods.

The panel timing generator 5 controls the driver timing generator 6 so that in an odd field, as shown in FIG. 2, the first output enable signal OE1 rises at the trailing (falling) edge of the CLKV pulse that causes the gate driver 11 to select the third scan line, and thereafter at the trailing edge of the CLKV pulse that causes the gate driver 11 to select the (6n+3)-rd scan line (n=1, 2, . . . ). For brevity, these CLKV pulses will be denoted CLKV-(6n+3). OE1 falls at the trailing edge of CLKV pulses that cause the gate driver 11 to select every 6n-th scan line, these CLKV pulses being denoted CLKV-6n. The second output enable signal OE2 rises at the trailing edge of CLKV-(6n+1), and falls at the trailing edge of CLKV-(6n+4), where n=0, 1, 2, . . . . The third output enable signal OE3 rises at the trailing edge of CLKV-(6n+5), and falls at the trailing edge of CLKV-(6n+8).

In an odd field, accordingly, when the gate driver 11 selects the first scan line at gate driver shift clock pulse CLKV-1, the gate driver 11 drives this scan line, because the first output enable signal OE1 is low. The gate driver 11 does not drive the second scan line, however, because OE2 is high at CLKV-2. Similarly, the gate driver 11 drives the third scan line, because OE3 is low at CLKV-3, but does not drive the fourth scan line, because OE1 is high at CLKV-4. Continuing in this way, the gate driver 11 drives only the odd-numbered scan lines, selected by the CLKV pulses that are cross-hatched in FIG. 2.

Referring to FIG. 3, in an even field, the panel timing generator 5 alters the timing relationship between STV and the output enable signals so that the first output enable signal OE1 rises at the trailing edge of CLKV-6n and falls at the trailing edge of CLKV-(6n+3), the second output enable signal OE2 rises at the trailing edge of CLKV-(6n+4) and falls at the trailing edge of CLKV-(6n+1), and the third output enable signal OE2 rises at the trailing edge of CLKV-(6n+2) and falls at the trailing edge of CLKV-(6n+5), where n=0, 1, 2, . . . . Pulse CLKV-0 is indicated by a dotted line because it does not select any horizontal scan line. The gate driver 11 does not drive the first scan line, because OE1 is high during CLKV-1, but drives the second scan line, because OE2 is low during CLKV-2. Continuing in this way, the gate driver 11 drives only the even-numbered scan lines.

In both the even and odd fields, accordingly, the output enable signals have periods equivalent to six scan lines, with phases mutually offset by intervals equivalent to two scan lines. The output enable signals in an even field are complementary to the output enable signals in an odd field.

The transfer of image signal data from the panel timing generator 5 to the source driver 12 is synchronized with the source driver shift clock CLKH and source driver start pulse signal STH, which the first counter 7 and first decoder 8 generate from DOTCLK, H-Sync, and DENB. Data transfer takes place during the high pulse periods of the data enable signal DENB, in the intervals denoted ODD1 to ODD384 in FIG. 2 and EVEN1 to EVEN384 in FIG. 3. Output of the image signal data from the source driver 12 to the liquid crystal panel 13 takes place during the corresponding periods in the SourceDATA waveform shown at the bottom of FIGS. 2 and 3.

Figure 4:
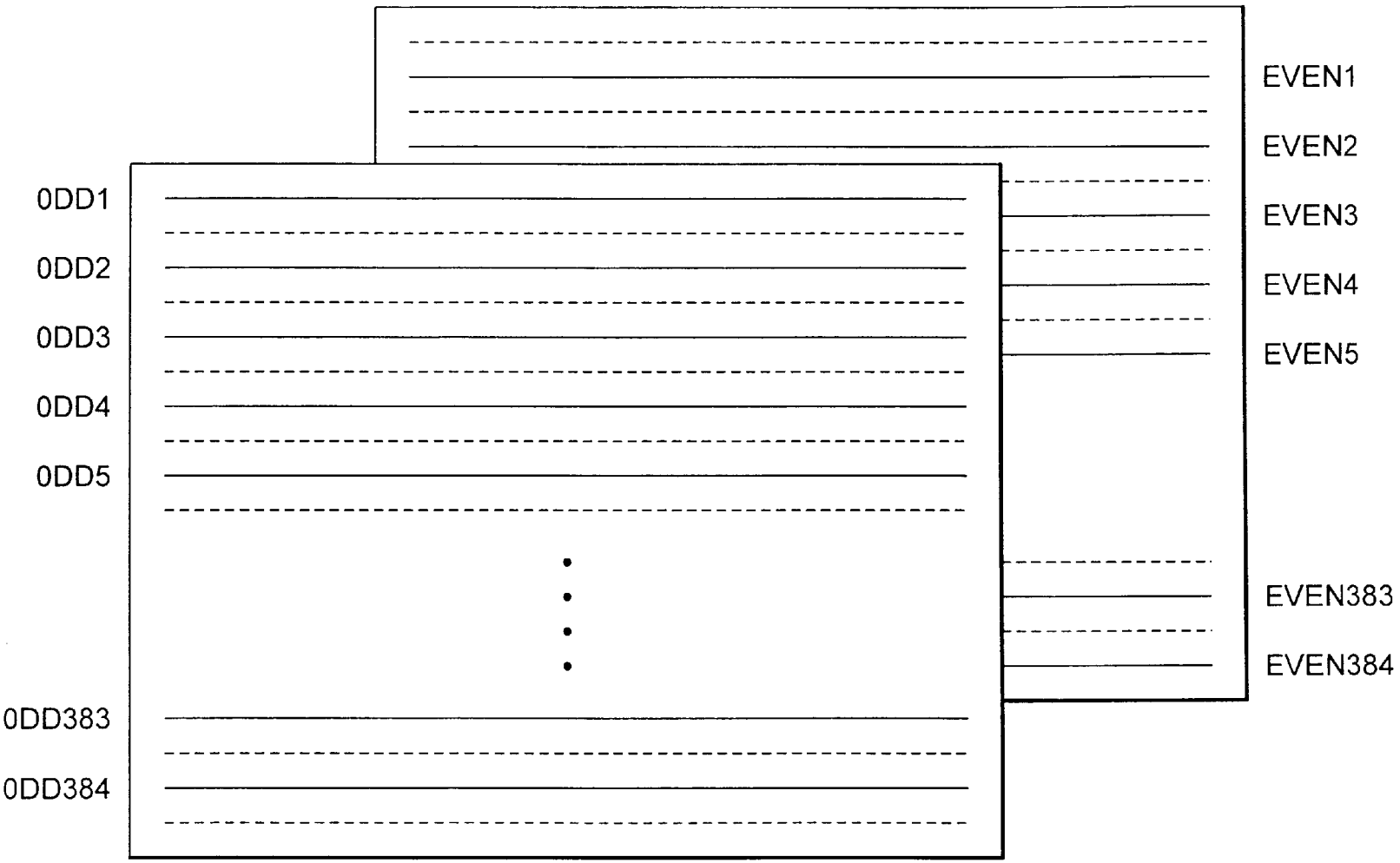
FIG. 4 illustrates the display of even and odd fields.

Consequently, in an odd field, the first line of data (ODD1) is displayed in the first scan line (1), the second line of data (ODD2) is displayed in the third scan line (3), and the last line of data (ODD384) is displayed in the seven hundred sixty-seventh scan line (767). In an even field, the first line of data (EVEN1) is displayed in the second scan line (2), the second line of data (EVEN2) is displayed in the fourth scan line (4), and the last line of data (EVEN384) is displayed in the seven hundred sixty-eighth scan line (768). The even and odd fields are thus displayed as shown in FIG. 4, producing a correctly interlaced image.

Figure 5:
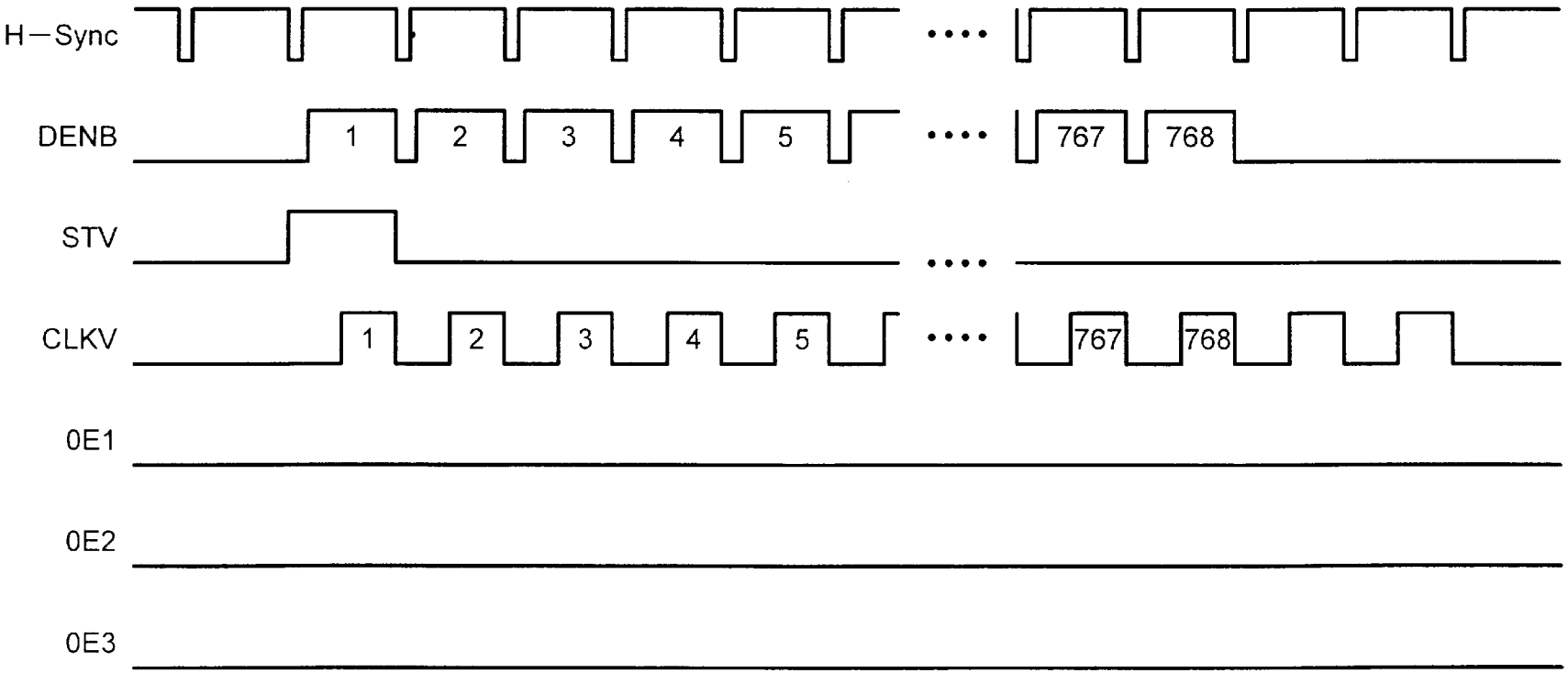
FIG. 5 is a timing diagram illustrating the operation of the apparatus in FIG. 1 for progressive scanning.

If the panel timing generator 5 determines that the received image signal employs progressive scanning, the driver timing generator 6 normally operates as shown in FIG. 5. The first counter 7 and first decoder 8 generate a gate driver shift clock CLKV having the same period and frequency as the horizontal synchronizing signal H-Sync. The CLKV pulse width is equal to one half of the H-Sync period. The second counter 9 and second decoder 10 generate a gate driver starting pulse STV having a pulse width equal to one H-Sync period. The falling edge of the STV pulse is aligned with the CLKV-1 pulse. The output enable signals OE1, OE2, OE3 are held low, enabling all scan lines in the liquid crystal panel 13 to be driven. Consecutive lines of data read from the line memory 4 during the intervals when-the data enable signal DENB is high are thus displayed in consecutive scan lines from the top to the bottom of the liquid crystal panel 13, as indicated by the numbers from one to seven hundred sixty-eight (1–768) in FIG. 5.

For both progressive and interlaced scanning, if possible, the panel timing generator 5 generates the horizontal synchronizing signal H-Sync and vertical synchronizing signal V-Sync at the same rate as in the horizontal and vertical synchronizing information received by the sync processor 3. The frame rate of the liquid crystal display is thereby adjusted to match the frame rate of the received video signal A. The gate driver 11, source driver 12, and liquid crystal panel 13 are capable of operating over a range of frame rates. If the frame rate of the received video signal A is within this range, no frame-rate conversion is performed.

Figure 6A:
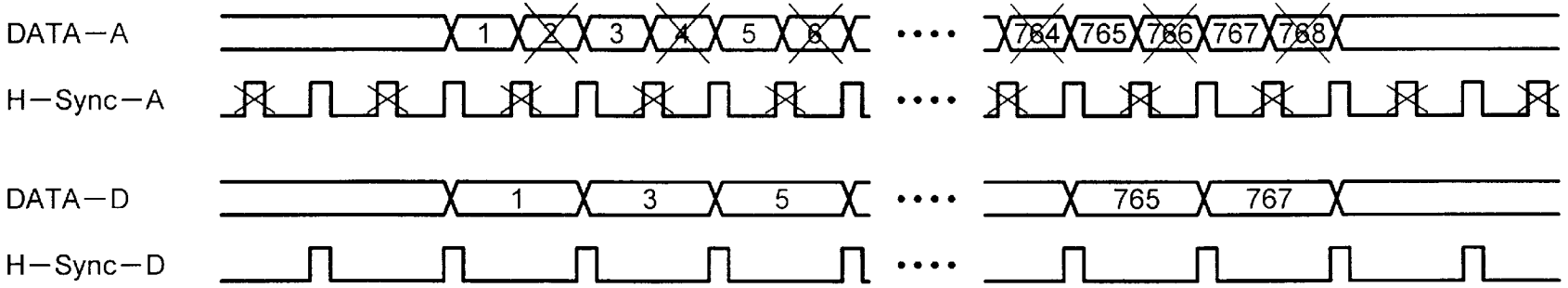
FIGS. 6A and 6B are timing diagrams illustrating conversion from progressive scanning to interlaced scanning.
Figure 6B:
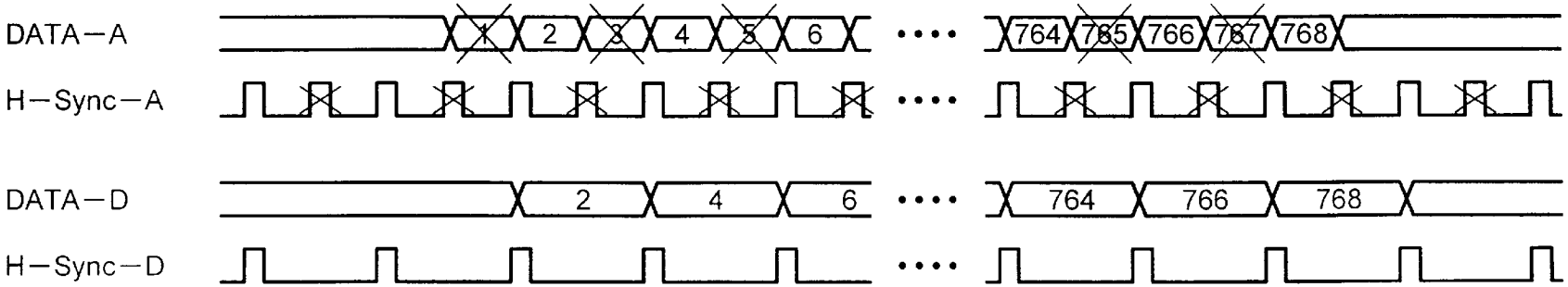

The computing device 1 may output a progressively scanned video signal at a frame rate higher than the maximum frame rate at which the liquid crystal display can operate. In this case, the panel timing generator 5 reduces the frame rate by converting the scanning system from progressive to interlaced, as illustrated in FIGS. 6A and 6B. The four waveforms in FIGS. 6A and 6B show one frame of received video data (DATA-A), the horizontal synchronizing-signal received by the sync processor 3 (H-Sync-A), the data read by the panel timing generator 5 from the line memory 4 (DATA-D), and the horizontal synchronizing signal generated by the panel timing generator 5 (H-Sync-D).

In odd-numbered frames, the panel timing generator 5 discards the even lines of data, leaving the odd lines, as shown in FIG. 6A. In even-numbered frames, the panel timing generator 5 discards the odd lines of data, leaving the even lines, as shown in FIG. 6B. The panel timing generator 5 controls the driver timing generator 6 as illustrated in FIGS. 2 and 3, so that the even and odd received frames become even and odd fields displayed on the liquid crystal panel 13. The frame rate is thereby reduced by a factor of two, the frame rate of the received signal becoming the field rate of the displayed video image.

In this way, the invented apparatus can display progressively scanned video signals having frame rates up to twice the maximum frame rate at which the liquid crystal panel 13 can operate, with negligible loss of image quality. In addition, when the frame rate is reduced by a factor of two, the panel timing generator 5 reduces the dot-clock frequency by a factor of two, thereby reducing the power consumption of the display apparatus, and simultaneously reducing electromagnetic noise emissions.

The invented display apparatus is thus able to display image signals employing both interlaced scanning and progressive scanning, with a wide range of frame rates, without requiring a frame memory.

Figure 7:
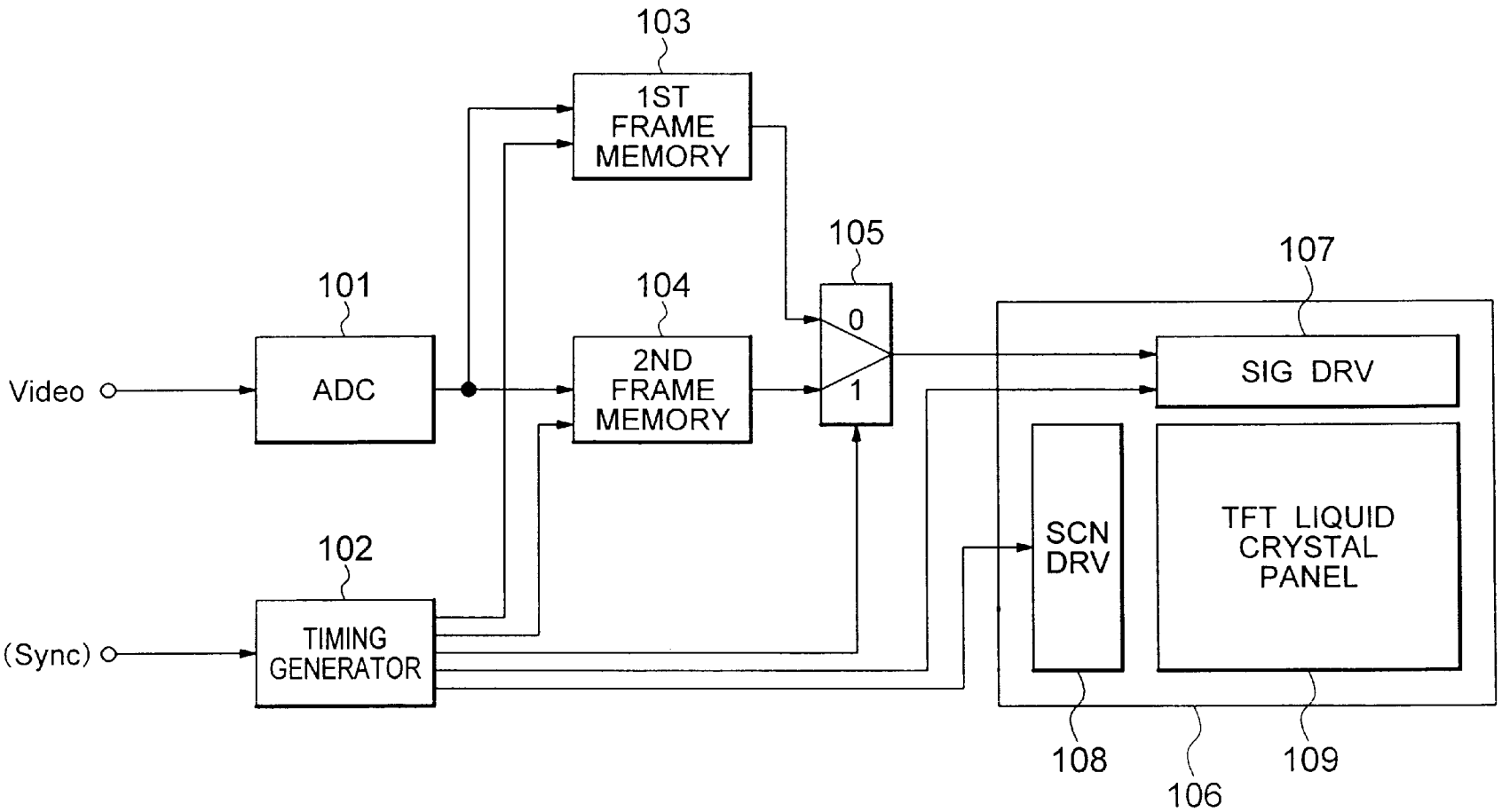
FIG. 7 PRIOR ART
FIG. 7 is a block diagram of a conventional image display apparatus.

For comparison, FIG. 7 shows a conventional display apparatus having an analog-to-digital converter 101, a timing generator 102, a first frame memory 103, a second frame memory 104, a switch 105, and a thin-film-transistor (TFT) liquid crystal display module 106. The TFT liquid crystal display module 106 comprises a signal electrode driving circuit (SIG DRV) 107 similar to the source driver in the preceding embodiment, a scanning electrode driving circuit (SCN DRV) 108 generally similar to the gate driver in the preceding embodiment, and a TFT liquid crystal panel 109. The timing generator 102 receives a synchronizing signal (Sync) and controls the switch 105, which couples one of the two frame memories 103, 104 to the signal electrode driving circuit 107. The timing generator 102 also controls the two driving circuits 107, 108 in the TFT liquid crystal display module 106.

If the received video signal employs interlaced scanning, this conventional display apparatus stores even fields in the first frame memory 103 and odd fields in the second frame memory 104, and reads lines from the two frame memories alternately, thereby converting from interlaced scanning to progressive scanning. If the received video signal employs progressive scanning, the upper half of each frame is stored in the first frame memory 103 and the lower half of each frame is stored in the second frame memory 104.

Since this conventional display apparatus does not convert progressive scanning to interlaced scanning, if the received video signal has a frame rate higher than the maximum frame rate at which the TFT liquid crystal display module 106 can operate, some loss of image quality is inevitable. If every second frame is completely discarded, for example, the displayed image may appear to flicker, because the reduced frame rate is too low. If entire frames are not discarded in this way, then a displayed frame may comprise parts of two different received frames, causing alignment defects in moving images.

The invented display apparatus does not suffer from these problems, because even when the frame rate is reduced by half, the field rate remains high enough to avoid flicker, and because each displayed field is derived from a single frame, preventing image alignment defects.

The use of three staggered output enable signals in the present invention enables interlaced images to be displayed without altering the basic line-selection sequence or the circuit structure of the gate driver.

By adjusting the frame rate of the displayed image according to the frame rate of the received image signal, the invented display apparatus derives each displayed frame or field from a single received frame or field, thereby avoiding image defects.

By converting from progressive to interlaced scanning, the invented display apparatus is able to display video signals having a frame rate up to twice the maximum frame rate at which the liquid crystal panel and its source driver can operate, without significant loss of image quality. By converting from progressive to interlaced scanning, the invented display apparatus can also reduce the dot clock rate by a factor of two, thereby reducing power consumption and reducing electromagnetic noise emissions.

The invention has been described above in relation to a liquid crystal display, but can be practiced with a plasma display panel (PDP), electroluminescent display (ELD), or any other type of matrix display panel.

The source of the analog video signal A need not be a workstation or personal computer. The invented apparatus can also be used to display interlaced video signals from other sources, including interlaced video signals complying with broadcast standards such as the NTSC standard or PAL standard. (NTSC stands for the National Television System Committee; PAL stands for phase alternation line.)

The number of output enable signals is not limited to three. The invention can be practiced with just one output enable signal, or any number of output enable signals greater than one.

Those skilled in the art will recognize that further variations are possible within the scope claimed below.

What is claimed is:

1. A method of displaying an image signal on a matrix display panel having a plurality of scan lines oriented in a first direction and a plurality of data lines oriented in a second direction, with picture elements disposed at intersections of the scan lines and data lines, comprising the steps of:

(a) determining whether the image signal uses interlaced scanning or progressive scanning;

(b) generating a shift signal selecting the scan lines one by one in consecutive order at a first frequency if the image signal employs progressive scanning and at a second frequency if the image signal employs interlaced scanning, the second frequency being double the first frequency;

(c) generating at least one output enable signal enabling the scan lines to be driven when selected; and (d) controlling the output enable signal so that every second selected scan line is driven, if the image signal employs interlaced scanning.

2. The method of claim 1, wherein a plurality of output enable signals are generated in said step (c), and if the image signal employs interlaced scanning, said step (d) makes the output enable signals periodic signals with periods equivalent to six of the scan lines, mutually offset in phase by intervals equivalent to two of the scan lines.

3. The method of claim 2, wherein the shift signal comprises consecutively numbered pulses selecting the consecutive scan lines, and if the image signal employs interlaced scanning, the output enable signals include:

a first output enable signal having transitions of a first type at trailing edges of shift-signal pulses with numbers of the form 6n, and transitions of a second type at trailing edges of shift-signal pulses with numbers of the form 6n+3;

a second output enable signal having transitions of a first type at trailing edges of shift-signal pulses with numbers of the form 6n+4, and transitions of a second type at trailing edges of shift-signal pulses with numbers of the form 6n+1;

a third output enable signal having transitions of a first type at trailing edges of shift-signal pulses with numbers of the form 6n+2, and transitions of a second type at trailing edges of shift-signal pulses with numbers of the form 6n+5;

where n is an arbitrary integer, the transitions of the first type alternating between rising and falling transitions as the image signal alternates between even and odd fields, the transitions of the second type being opposite to the transitions of the first type.

4. The method of claim 1, further comprising the steps of:

(e) determining whether the received image has a frame rate exceeding a predetermined frame rate;

(f) controlling the output enable signal so that all of the selected scan lines are driven, if the image signal employs progressive scanning and has a frame rate not exceeding the predetermined frame rate; and (g) controlling the output enable signal so that every second selected scan line is driven, if the image signal employs progressive scanning and has a frame rate exceeding the predetermined frame rate, thereby converting the progressive scanning to interlaced scanning.

5. The method of claim 4, further comprising the steps of:

(h) generating a dot clock signal;

(i) supplying the image signal to the matrix display panel in synchronization with the dot clock signal; and (j) reducing a frequency of the dot clock signal if the image signal employs progressive scanning and has a frame rate exceeding the predetermined frame rate.

6. The method of claim 1, further comprising the steps of:

(k) storing the image signal in a line memory; and (l) supplying the image signal from the line memory to the matrix display panel.

7. An image display apparatus having a matrix display panel with a plurality of scan lines oriented in a first direction, a plurality of data lines oriented in a second direction, picture elements disposed at intersections of the scan liens and the data lines, a gate driver driving the scan lines, and a source driver driving the date lines comprising:

a driver timing generator generating a shift signal causing the gate driver to select the scan lines one by one in consecutive order at a first frequency if the image signal employs progressive scanning and at a second frequency if the image signal employs interlaced scanning, the second frequency being double the first frequency, generating at least one output enable signal enabling the gate driver to drive the selected scan lines, and controlling the output enable signal so that every second selected scan line is driven if the image signal employs interlaced scanning.

8. The image display apparatus of claim 7, wherein the driver timing generator generates a plurality of output enable signals, and if the image signal employs interlaced scanning, the output enable signals are periodic signals with periods equivalent to six of the scan lines, mutually offset in phase by intervals equivalent to two of the scan lines.

9. The image display apparatus of claim 8, wherein the shift signal comprises consecutively numbered pulses selecting the consecutive scan lines, the scan lines also being consecutively numbered, and if the image signal employs interlaced scanning, the driver timing generator generates, as said output enable signals:

a first output enable signal having transitions of a first type at trailing edges of shift-signal pulses with numbers of the form 6n, and transitions of a second type at trailing edges of shift-signal pulses with numbers of the form 6n+3, enabling the gate driver to drive scan lines with numbers of the form 3n+1;

a second output enable signal having transitions of a first type at trailing edges of shift-signal pulses with numbers of the form 6n+4, and transitions of a second type at trailing edges of shift-signal pulses with numbers of the form 6n+1, enabling the gate driver to drive scan lines with numbers of the form 3n+2;

a third output enable signal having transitions of a first type at trailing edges of shift-signal pulses with numbers of the form 6n+2, and transitions of a second type at trailing edges of shift-signal pulses with numbers of the form 6n+5, enabling the gate driver to drive scan lines with numbers of the form 3n+3;

where n is an arbitrary integer, the transitions of the first type alternating between rising and falling transitions as the image signal alternates between even and odd fields, the transitions of the second type being opposite to the transitions of the first type.

10. The image display apparatus of claim 7, further comprising a panel timing generator generating a dot clock signal, a horizontal synchronizing signal, a vertical synchronizing signal, and a data enable signal, supplying the dot clock signal, the horizontal synchronizing signal, the vertical synchronizing signal, and the data enable signal to the driver timing generator, and supplying image data to the source driver in synchronization with the dot clock signal while the data enable signal is active.

11. The image display apparatus of claim 10, further comprising a line memory storing the image data for one scan line at a time, the panel timing generator reading the image data from the line memory.

12. The image display apparatus of claim 10, wherein the driver timing generator comprises:

a first counter receiving the dot clock signal, the horizontal synchronizing signal, and the data enable signal from the panel timing generator;

a first decoder decoding an output of the first counter to generate the shift signal;

a second counter receiving the shift signal from the first decoder and the vertical synchronizing signal from the panel timing generator; and a second decoder decoding an output of the second counter to generate the output enable signal.

13. The image display apparatus of claim 12, wherein the first decoder also generates a source driver starting pulse signal and a source driver clock signal, and supplies the source driver starting pulse signal and the source driver clock signal to the source driver,for use in receiving the image data from the panel timing generator.

14. The image display apparatus of claim 12, wherein the second decoder also generates a gate driver starting pulse signal, and supplies the gate driver starting pulse signal to the gate driver, thereby causing the gate driver to select an initial one of the scan lines.

15. The image display apparatus of claim 10, wherein:

if the image signal employs progressive scanning and has a frame rate not exceeding a predetermined frame rate, the output enable signal generated by the driver timing generator enables all selected scan lines to be driven; and if the image signal employs progressive scanning and has a frame rate exceeding the predetermined frame rate, the output enable signal generated by the driver timing generator enables the gate driver to drive every second selected scan line, and the panel timing generator supplies the source driver only with the image data for the driven scan lines.

16. The image display apparatus of claim 15 wherein, if the image signal employs progressive scanning and has a frame rate exceeding the predetermined frame rate, the output enable signal generated by the driver timing generator enables the gate driver to drive only odd-numbered scan lines in a first frame of the image signal, and only even-numbered scan lines in a second frame of the image signal.

17. The image display apparatus of claim 15, wherein the panel timing generator reduces a frequency of the dot clock signal if the image signal employs progressive scanning and has a frame rate exceeding the predetermined frame rate.

* * * * *